United States Patent [19]

Fricke

[11] 4,028,851

[45] June 14, 1977

[54] SPARKPLUG CLEANER

[76] Inventor: Roy A. Fricke, 1034 Ashland Ave., River Forest, Ill. 60305

[22] Filed: June 3, 1976

[21] Appl. No.: 692,341

[52] U.S. Cl. ..... 51/412; 51/424; 51/434

[51] Int. Cl.[2] ..... B24C 3/34

[58] Field of Search ..... 51/8 SP, 8 C, 8 R, 8 BR, 51/9 R, 9 M; 241/172

[56] References Cited

UNITED STATES PATENTS

| | | | |
|---|---|---|---|
| 2,277,911 | 3/1942 | Johnson | 51/8 SP |
| 3,802,633 | 4/1974 | Schold | 241/172 |
| 3,868,790 | 3/1975 | Fricke | 51/8 SP |

*Primary Examiner*—Gary L. Smith
*Assistant Examiner*—Robert C. Watson
*Attorney, Agent, or Firm*—Johnson, Dienner, Emrich & Wagner

[57] ABSTRACT

The sparkplug cleaner of the present invention provides a closed container, comprising a cylindrical barrel member open at its upper end. Its upper open end is adapted to be closed by a cover member, upon the center of which is mounted an electric motor having a vertical shaft extending down through the cover member. The said shaft on its lower end, inside the container, carries a closed impeller rotatable in a horizontal plane to throw the particulate abrasive out tangentially. Inside the cup-shaped barrel member, and below the impeller, are mounted guiding vanes for guiding the return flow of airborne abrasive particles carried upwardly in a swirling airflow circulation created by the rotating impeller.

15 Claims, 10 Drawing Figures

Fig. 6
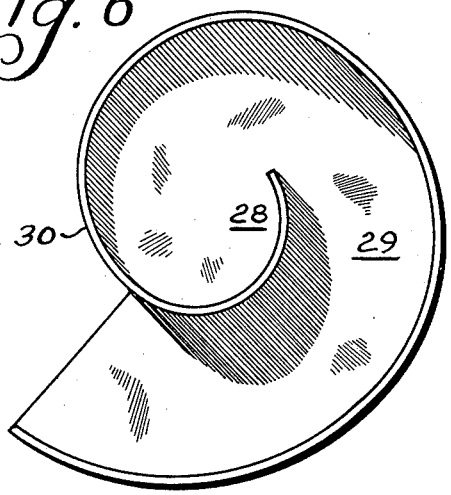
Fig. 7
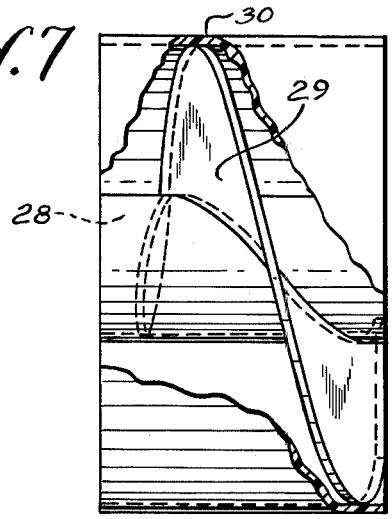
Fig. 8
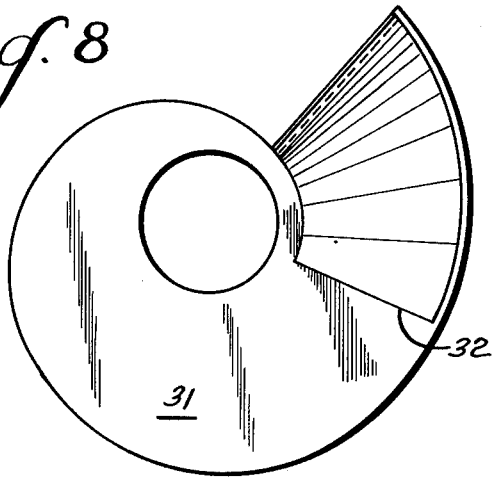
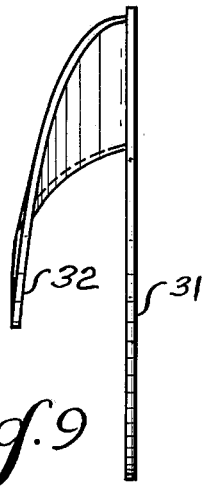
Fig. 9
Fig. 10
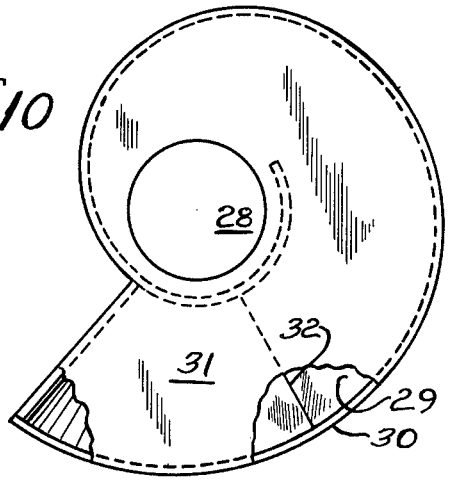

SPARKPLUG CLEANER

BRIEF SUMMARY OF THE INVENTION

In the side walls adjacent the upper end of a cylindrical member there are mounted a plurality, (in the form illustrated herein, 8), of radially disposed sparkplug holders, for releasably supporting and holding the threaded inner ends of sparkplugs in position to expose them to be impinged and thereby be cleaned, by the projection of a blast of abrasive particles against them. The individual holders are elastic and are self-sealing relative to the plugs, and are self closing when the inserted plug is withdrawn from the holder. The plugs to be cleaned are carried by their threaded mounting ends gripped in said self sealing elastic supports. The electrode ends of the sparkplugs are thus disposed in a common horizontal plane in flexible mountings which allow the plugs to be individually wobbled by the hand of the operator to expose the electrodes and supporting insulation to be impinged from different angular directions by the blast of abrasive particles.

In prior structures the sparkplug to be cleaned is mounted in a removable holder adapted to the size and threads of the specific form of sparkplug to be cleaned. For different sizes of plugs corresponding holders are required, whereas in the present sparkplug cleaner the plug holder automatically adapts itself to grip various sizes and/or threads of spark plugs.

Also the structure and mode of operation of sparkplug cleaners of the prior structures required the operator to turn the entire device over endwise a full revolution in a specific direction to collect and locate the particulate in the supply hopper located above the intake to the impeller in that device, in order to perform a second run of the particulate through the impeller unit; whereas the device of the present invention will run uninterruptedly and will continue to pick up and apply the particulate to the spark plug terminals uninterruptedly so long as the motor switch is kept closed.

The lower end of the barrel, that is, the part of the barrel below the impeller, contains guiding vanes that receive the particulate, after its discharge and impingement against the spark electrodes and guide it into the receiving end of a combination helical-spiral duct which leads from the bottom of the barrel upwardly to a central exit of reduced cross section registering with the axial inlet of the closed impeller, which is supported immediately above it.

The particulate when it enters the eye of the impeller is energized by the rotary motion of the impeller blades, and subject to the inertia of the solid particles, to be thrown and blown outwardly into contact with the ends of the sparkplugs which areexposed for cleaning by such impingement. The air which is also driven by the impeller carries the particulate abrasive in the radially outermost part of the path which the air and particulate travels. The stationary guiding spiral walls or vanes below the impeller guide the particulate carried in the air-stream through a path which comprises a duct of diminishing cross-section and increasing gas velocity into the entry port of the closed impeller where the impeller blades increase the velocity of the particles to a maximum and discharge them against the sparkplug electrodes.

In the absence of the particulate the device merely circulates air in a closed path with a maximum velocity at the region of release of the moving air at the impeller blade tips where discharge of air against the sparkplug inner end occurs. without effect.

The impeller and the guiding surfaces of the guiding vanes or walls are so constructed as to discharge the particulate at high velocity and to release the carrying air downwardly in the closed container along with the gravitation of the particulate, to the lower end of a helical guiding surface from where the air stream can carry the particulate upwardly against gravity at increasing velocity and put it again within the power of the mechanically driven impeller. The travel of the stream of air and the particulate occurs entirely within the confines of the closed container.

A cleaning operation of removing deposited carbon from the electrodes and the porcelain insulator of a sparkplug is conducted in a closed cylindrical box of small dimensions. A motor driven impeller rotating on a vertical axis circulates a charge of particulate carried in a stream of air through a closed path inside the container. The motor driven impeller in the upper end of the closed barrel drives the particulate in a stream of air at high velocity in a horizontal plane into contact with the sparkplugs which are mounted in flexible seats disposed radially about the impeller. The difference in density between the particulate and the air and carbon dust presents a problem of effeciently projecting the particulate abrasive at high velocity against the series of sparkplugs which are to be treated at one time and then to recapture the abrasive particulate by collecting the same and passing it again through the high speed impeller to chip the carbon deposit off of the inside surface of the sparkplug. The problem is to carry on in the closed container the activity of centrifugally projecting the air and the particulate of high specific gravity at high velocity against the surfaces of the sparkplugs and then to collect the air and the spent particulate and again discharge them together against the sparkplug terminals. I perform this operation by using the air to fluidize the particulate to create the high velocity of the particulate. To get the two ingredients into fluidized condition again I allow the particulate to gravitate down to the foot of an incline and employ the stream of circulating air to push the particulate up the incline into the entrance of air into the high speed impeller where both the air and the particulate are accelerated to high speed for projecting the particulate and air onto the surface to be scoured by the particulate. The air carries off with the particulate the carbon deposit which the particulate has chipped loose, namely, the deposited carbon. The particulate having lost its energy tends to gravitate to the lowest available spot. Then to get the particulate up to the intake of the impeller applicant causes the stream of air accelerated by suction to slide the particulate up the incline to the suction inlet of the impeller. The utilization of the spiral incline to lift the particulate up to where it is put under the direct influence of the suction of the impeller is the essence of the invention. The problem was to get the particulate back within the power of the impeller. The incline with a current of air does it.

BRIEF DESCRIPTION OF THE DRAWINGS

FIG. 6 is a perspective view of an assembly of the particulate lifting vane and the spiral vane.

FIG. 7 is right side elevation of FIG. 6.

FIG. 8 is a bottom plan view of the headplate and attached spiral airflow accelerating vane.

FIG. 9 is an edgewise view of the accelerating vane and headplate shown in FIG. 8; and FIG. 10 is a top plan view of the assembly of the two parts shown edgewise in FIG. 7.

DETAILED DESCRIPTION

Figure 1:
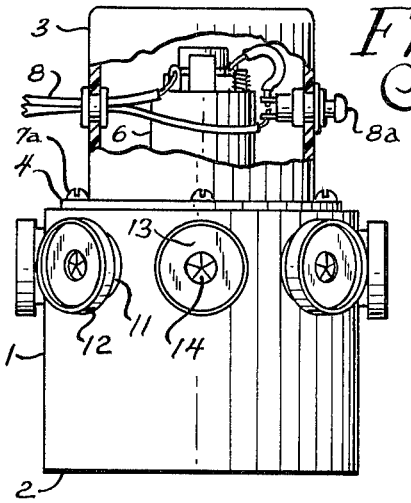
FIG. 1 is a side elevation of a sparkplug cleaner embodying my present invention, (a part of the motor cover being broken away).

Referring first to the externally visible parts, the sparkplug cleaner of the invention comprises a cylindrical barrel 1 which comprises a cylindrical sidewall which is closed by a bottom wall 2 which is preferably made of transparent synthetic plastic material which may be moulded. An inverted cup-shaped motor housing or cover 3 has a clamping flange 4 for mounting the same upon the disc-like head or closure 5 of the barrel 1. The joint between the coverplate 5 and the upper end of the barrel 1 comprises a broken joint to reduce leakage of air and any particles or dust carried thereby during operation of the device. The coverplate 5 carries the driving motor 6 which has its frame connected to the coverplate 5 by clamping screws 7*a*—7*a* which hold the motor shaft axially at right angles to the plate 4. The motor frame of motor 6 is clamped to the coverplate 4 by screws 7—7 which hold the motor to the plate 4 inside of the motor cover 3. The electrical leads 8 are connected through the snap switch 8*a* to control the starting and stopping of the motor 6. The driving motor is a series type motor and its top speed is in the neighborhood of 3,000 to 5,000 RPM.

Figure 3:
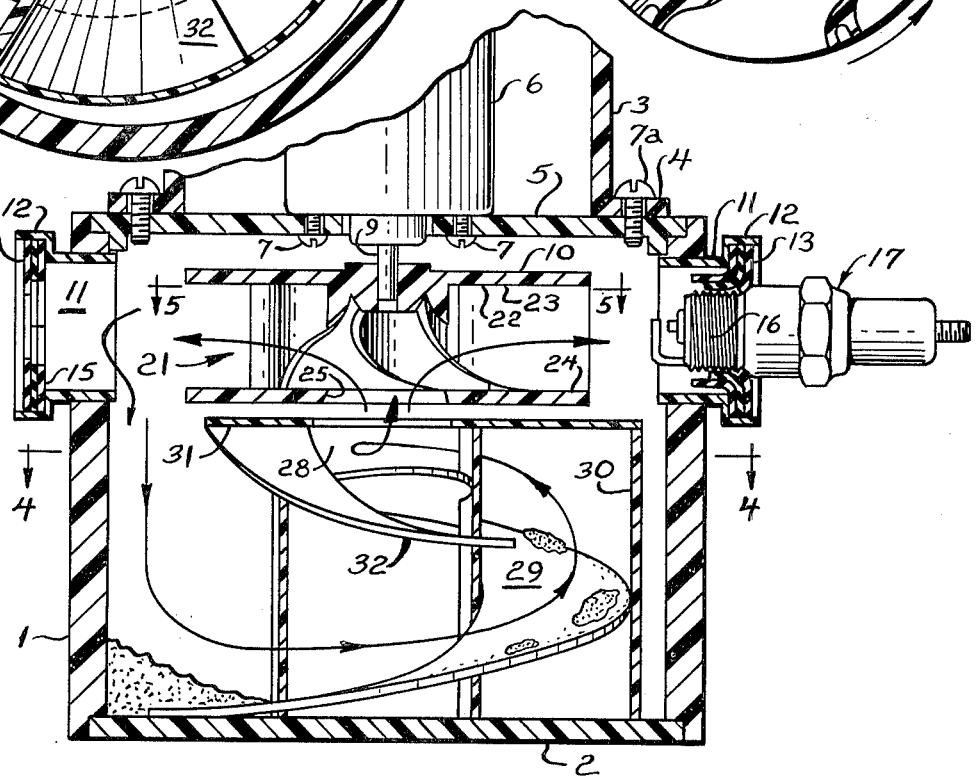
FIG. 3 is a vertical diametrical section of the lower part of the structure of FIG. 1 taken on line 3—3 of FIG. 4.

The shaft 9 of the motor 6 extends down vertically within the outer main housing or barrel 1 and it carries the impeller 10 far enough below the top of the wall of barrel 1 to allow the impeller to discharge below the top of the sidewall of the shell 1 to allow mounting of the periphery of the impeller to register vertically with the short flanged sleeves 11 which at their inner ends are set in circular openings on a common level in the sidewall of the barrel 1. Each short plug-holding sleeve 11 has a flange providing an enlarged circular seat 12 for receiving three elastic discs 13, 14 and 15, the inner two of which at their centers are slitted radially and assembled with the slits out of register so they are overlapped. The outermost disc 13 is not slitted but is an integral flat ring and being highly elastic stretches over the threaded portion 16 of the shell of sparkplug 17 as illustrated in FIG. 3. The inner two discs 14 and 15 are slitted with radial slits extending from the center part way radially through the width of the plug sleeve and the slits are angularly out of register with each other so that when the sparkplug is pushed through the elastic v-shaped sections of the discs they overlap each other being out of register, and provide a closure between the mounting barrel 11–12 and the sparkplug barrel 16. The outer disc 13 is expanded by the entry of the sparkplug barrel and merely stretches tight to grip the sleeve 16 of the plug.

Figure 2:
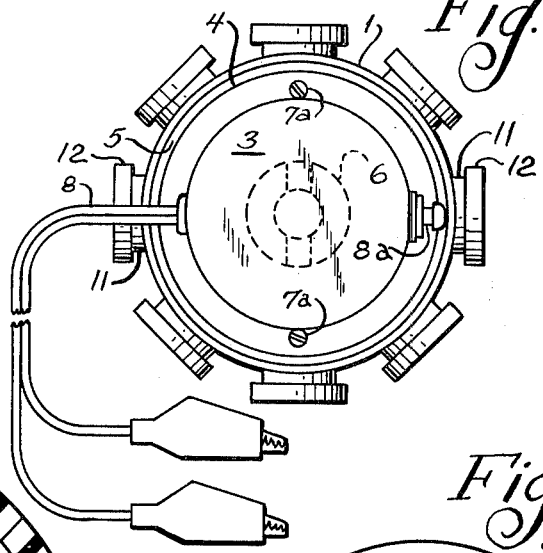
FIG. 2 is a top plan view of the device shown in FIG. 1.
Figure 4:
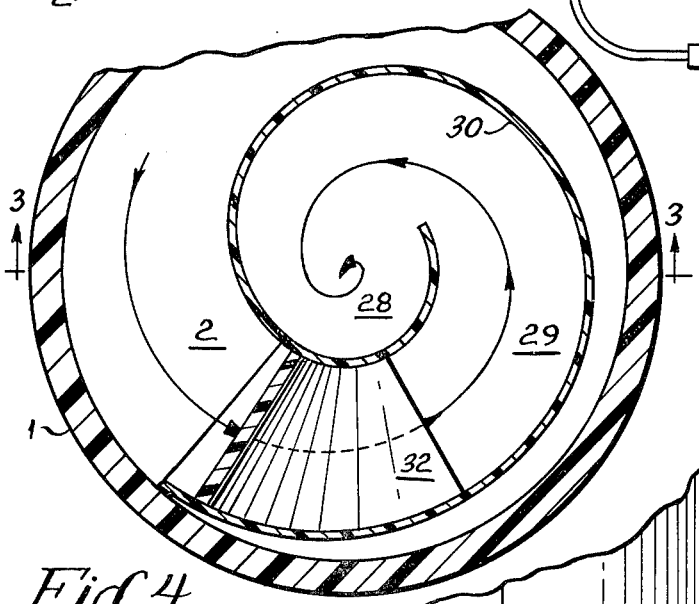
FIG. 4 is a horizontal section of the structure shown in FIG. 1 taken on the line 3—3 of FIG. 4.
Figure 5:
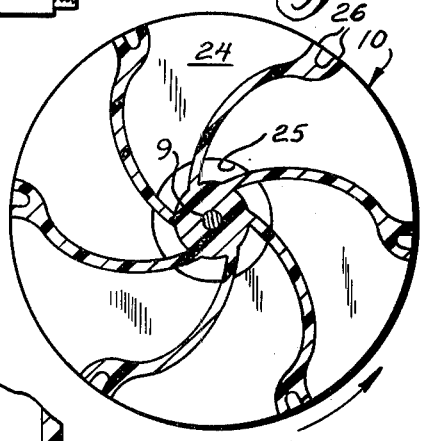
FIG. 5 is a horizontal section of the impeller taken on the line 5—5 of FIG. 3.

The barrel 1 which is preferably made of a rigid transparent plastic, supports, in the embodiment shown, eight equally angularly spaced sparkplug holders 12 on a common level as shown in FIGS. 1, 2 and 3. The holders, when not occupied by sparkplugs, are self-closing, and are not opened by the internal pressure of the blower-impeller. The elastic discs yield to admit the threaded end of a sparkplug and hold the plug in a horizontal position as shown in FIG. 3. Those holders 11 which are not occupied by sparkplugs remain closed.

The joint between the coverplate 5 and the open end of the cylindrical barrel 1 is a broken or zig-zag joint which aids both the security of mechanical support and the desired quality of sealing the joint against inward or outward leakage when the device is in operation. Any number of sparkplugs up to the limit of eight may be cleaned in the specific embodiment illustrated in the drawings. Plugs of a number less than eight may be cleaned since the holders 12 are self-closing. The radial cuts in the two discs 14 and 15 are angularly out of register and the extent of the slits is slightly less than the diameter of the threaded part of the plug and the slit discs 14–15 embrace the plug to the extent that the particulate is prevented from escaping at the joint between the plug and the barrel or housing.

The motor 6 is attached to the coverplate 5 which supports the motor 6 with its shaft 9 rotatable on a vertical axis. The impeller 10 has a series of curved blades joined to top and bottom discs 23, 24. The upper edges of the impeller blades 22 are formed integral with the top disc 23. The lower disc 24 is similarly formed integral with the outer extremities of the impeller blades. These blades are attached at their upper ends to the upper disc 23 and their lower edges are helicoid with a central cavity for receiving the inflow of air and particulate during the cleaning operation. The lower disc 24 is annular. It has an entry port 25 at the center through which a flow of air and airborne particulate is inhaled through the blowing effect of the impeller.

The radially outermost ends of the impeller blades are split vertically, that is, axially to present each longitudinal terminal portion of the impeller blade as two divergent vertical blades 26 having their outer edges on the same radius with respect to the motor shaft and being divergent. The split of the outer edge of the impeller blade operates to increase the life of the blade and to maintain the effective diameter of the impeller longer than a single edge blade.

The rotary blower 21 has its inlet port 25 disposed in close relation to the upper end of the central passageway 28 in the circulating duct system defined by the duct system between the peripheral discharge of the rotary blower 21 and reentry of the abrasive particulate into the impeller through the central intake opening 25 of the lower plate of the said rotary blower 21 which supplies the energy for circulating the particulate abrasive which is projected against the exposed ends of the sparkplugs held in the plug holders 12.

The cleaning operation involves projecting the abrasive particles at sufficient velocity and in suficient volume to chip the carbon deposit on the electrodes and insulation of the plugs exposed to this action. Such a circulation involves imparting the necessary energy to the particles and directing them against the surfaces to be cleaned. A successful treatment of this character requires that the particulate be repeatedly applied to the surfaces to be cleaned and that is performed by the circulation of a small quantity of the abrasive in a continuous stream during the period of treatment.

The deposited carbon has a low specific gravity compared to that of the abrasive in the particular closed circuit of the present device. The carbon deposit is substantially pulverized by impact of the abrasive grains and is in general ground to a fine powder which does not seriously interfere with the cleaning operation by the particulate which is projected against the carbon deposit.

The problem however of gaining control of the particulate after it has been projected against the surfaces to be cleaned finds its solution in the present invention. The particulate, and any incidental carbon powder which is present, must be collected and restored to the control of the rotary blower or impeller for repeated applications to the surfaces to be cleaned. The relatively light carbon powder may be regarded much like the contained air as an unavoidable diluent of the abrasive particles. The duct system for circulating the abrasive and such material as is loosened from the surfaces impinged is allowed to fall to the bottom of the containing barrel 1 with the downward current of air. The blast of the impeller carries the abrasive and carbon dust upwardly on an incline path which, in this case, is a helix and delivers it into the intake or suction port in a spiral pathway to the center of the impeller where it is drawn by the suction of the impeller and entering the blades is projected out generally in a tangential direction by the throw of the impeller blades. The path of a particulate abrasive grain is not in a radial direction but is in a tangential direction relative to the impeller so that the particulate grain strikes the electrodes and the insulation in a direction diagonally outwardly and diagonally relative to the axis of the sparkplug in the holder.

The operator rotates the sparkplug preferably with a wobbling motion to present the axis of the plug in different positions relative to the direction of the particles driven by the impeller. Since the particulate is of high specific gravity it is not readily lifted in a current of air. I overcome this difficulty by the incline path along which the particulate grains is carried upwardly by the stream of moving air impelled by the impeller. The air by itself does not pick up the particuate abrasive grains but lifts them up to the impeller intake by pushing them up an incline.

I claim:

1. In a portable sparkplug cleaner a closed cylindrical vessel having a vertical axis and comprisng two communicating but functionally separate, vertically aligned cylindrical chambers, a driving motor having a vertical shaft disposed in the upper chamber and having a centrifugal, rotatably mounted impeller in the upper chamber, there being a series of tubular radially disposed flexible self-sealing sparkplug holders mounted radially in the cylindrical walls of the first chamber and being arranged in a concentric array and being adapted to receive and hold the threaded electrode ends of sparkplugs to be cleaned, said centrifugal impeller in the upper part of said vessel being journaled in said vessel and being driven by said motor, and having means for discharging particulate against the electrodes of the sparkplugs from various tangential directions, the lower part of the vessel providing a receiving chamber for receiving spent particulate gravitating into said chamber.

2. The combinations with claim 1 of a spiral vane disposed in the lower chamber for cooperating with the suction at the inlet of the impeller for raising and accelerating particulate from the lower chamber to be discharged by said impeller.

3. In combination a closed container comprising a bottom wall, a top wall and cylindricl sidewalls extendingbetween said top and bottom walls to form an enclosed substantially cylindrical space, for receiving and containing a charge of abrasive particulate a sparkplug holding and sealing means extending radially through the upper end of the sidewalls of said container for holding and exposing the spark terminal electrodes of a plurality of sparkplugs seated in said holding and sealing means in a ring around the upper end of the sidewalls, a closed impeller having a lower sideplate with a central inlet opening and having an upper sideplate with a vertical supporting drive shaft connected to said upper sideplate a driving motor on said top wall for operating said impeller drive shaft and impeller, a series of impeller blades extending between the lower apertured impeller sideplate and the top impeller sideplate and directing vanes disposed in said cupshaped container for directing air and particulate discharged from the impeller in a spiral path from the bottom of the container to the inlet opening in the open bottom sideplate of the impeller.

4. In a sparkplug cleaner a closed cylindrical container having a releasable horizontal top wall, and an upwardly open cup comprising vertically extending sidewalls, said container containing a charge of abrasive particulate, a motor mounted on said top wall, said motor having a shaft disposed vertically and extending through said top wall, a closed impeller mounted on said shaft below said top wall said impeller having spaced horizontal discs with spaced impeller blades between said discs, the lower disc having a central intake opening communicating with spaces between said blades, the upper disc being imperforate, the upper end of the sidewalls of said cup having a horizontal row of openings extending therethrough on a common level, means for holding in sealed relation to the edges of the sidewall openings a plurality of sparkplug holders for holding the threaded ends of the held sparkplugs with their longitudinal axes disposed on substantially a common level with the horizontal discharge of said impeller, whereby energization of the motor and rotation of said impeller creates an interior circulation of contained air and particulate and drives the same against the exposed ends of said sparkplugs held in said holders.

5. The combination of claim 4 wherein said sparkplug holders comprise an elastic flexible seal permitting wobbling of the sparkplugs held therein to expose the sparkplug electrodes at various angles to the discharge of particulate by the impeller.

6. The combination of claim 5 with means for returning the spent particulate after it is projected by said impeller against a sparkplug, comprising a collecting zone in the lower end of the closed container and a spirally upwardly extending passageway of diminishing cross section extending to the inlet opening in the center of the lower sideplate.

7. The combination of claim 6 wherein said means for returning the spent particulate to the impeller comprises a parallel sided strip of a width equal to the height of lift of the particulate from the floor of the said open cup to the intake opening of the lower disc of the impeller said strip being coiled to a terminal cylindrical curvature substantially equal to the curvature of the impeller inlet opening, and being supported in register therewith.

8. The combination of claim 7 wherein the lifting of the particulate from the floor of the cup to the intake of the impeller is performed by said helically coiled parallel sided strip in cooperation with a spirally coiled strip of maximum effective radial width at its lower end and being of a minimum effective radial width at its upper end, said minimum radial width being substantially equal to the radius of the opening in the lower disc of the impeller.

9. A sparkplug cleaner comprising a closed vessel containing a charge of abrasive particulate and having flexible holders for holding the threaded ends of a series of sparkplugs comprising spaced insulated electrodes and an intervening insulator exposed interiorally of said vessel, a motor driven blower-impeller in said vessel, an annular discharge duct leading from said impeller and directing the discharge of particulate by the blower-impeller against said exposed electrodes and insulation, each of said flexible holders being capable of independent limited universal gyratory movement to expose the electrodes and insulator to the impingement of the abrasive particulate discharged by the blower-impeller.

10. The sparkplug cleaner of claim 9 wherein the upper end of the sidewalls of said closed vessel comprises a series of sparkplug holders for holding the threaded ends of a plurality of sparkplugs individually substantially in horizontal alignment with the discharge of abrasive particulate by said impeller, said sparkplugs being mounted in flexible holders to allow each plug to be wobbled on its mounting to expose the electrodes and their insulation to impingement of discharged particles from different directions.

11. The sparkplug cleaner of claim 9 wherein said blower-impeller has an upper closed disc and a lower disc with a central inlet port, a series of radially extending curved blades connected between said discs and jointed by a central hub; the outer ends of said blades being split into parallel vanes extending parallel to the longitudinal axis of the hub.

12. In a sparkplug cleaner a cup-shaped container having a bottom wall and connected cylindrical sidewalls open at the top, a series of tubular sparkplug holders, mounted with longitudinal axes horizontal, and extending through and being supported in the upper end of the cylindrical sidewalls, each in a generally radial position with respect to the sidewalls, and adjacent the upper end of said sidewalls said holders each having flexible means for gripping and holding the threaded ends of a sparkplug and allowing wobbling motion of the sparkplug so held, a cover for the upper open end of the cup-shaped container, and electric motor mounted on top of said cover with its shaft extending down vertically through said cover, a closed impeller with its inlet opening facing downwardly, mounted on said shaft, the closed impeller having its peripheral outlet registering vertically with the sparkplug holders to project its discharge into the open end of the sparkplugs mounted in said holders, said impeller being disposed a substantial distance above the bottom of the container, guiding vanes in the container below the impeller, said vanes comprising a spiral vane extending from the bottom of the container to a point adjacent the central inlet opening of the closed impeller for returning particulate discharged horizontally by the impeller and gravitated downwardly toward the bottom of the cup.

13. In a sparkplug cleaner a closed vessel comprising a cylindrical cup-shaped lower portion facing upwardly and having a plurality of tubular sparkplug holders comprising radially extending apertures through the sidewalls disposed in horizontal alignment in a ring said apertures being covered by elastic diaphragms which have crossing slits at their center for receiving and realigning the threaded ends of sparkplugs and holding them in said apertures in radial position said closed vessel comprising a cover member closing the open top of said cup-shaped portion, an electric motor having a shaft projecting vertically down through the center of the cover member and carrying a closed impeller having an upper closed plate carried on said shaft a lower plate with a central inlet opening and a series of impeller blades between said upper and lower plates aligned horizontally with the sparkplug holders for projecting particulate against the electrodes of sparkplugs held in said sparkplug holders;

the lower portion of said cup-shaped body containing a spiral vane providing a guiding passageway from the lower part of said cup-shaped body portion of the closed vessel to the central inlet of the lower sideplate of the impeller for conveying particulate from the lower part of the vessel to the intake opening on the lower side of the impeller.

14. The sparkplug cleaner of claim 13 wherein the particulate discharged against the exposed ends of sparkplugs held in said sparkplug holders drops down to the lower end of the cup-shaped vessel and in contact with said spiral vane the effective pitch of which increases toward the inlet opening of the impeller.

15. The combination of claim 13 with an air flow velocity controlling vane 32 located above the lower end of the spiral vane 29 for increasing the velocity of the air flow whereby to cause upward sliding movement of the spent particulate on said vane 29.

* * * * *